US007228814B1

(12) United States Patent
Williams, Sr.

(10) Patent No.: US 7,228,814 B1
(45) Date of Patent: Jun. 12, 2007

(54) FLAG STORAGE AND SUPPORT APPARATUS

(76) Inventor: Brian F. Williams, Sr., 7116 Starnes Rd., North Richland Hills, TX (US) 76180

( * ) Notice: Subject to any disclaimer, the term of this patent is extended or adjusted under 35 U.S.C. 154(b) by 3 days.

(21) Appl. No.: 11/150,771

(22) Filed: Jun. 13, 2005

(51) Int. Cl.
*G09F 17/00* (2006.01)

(52) U.S. Cl. ..... 116/173; 248/514; D11/166

(58) Field of Classification Search ..... 116/173; 248/292.12, 514, 520, 532; 40/606.03, 607.01, 40/607.04, 611.03; 312/245, 242, 224; D11/165, D11/166, 181, 182
See application file for complete search history.

(56) References Cited

U.S. PATENT DOCUMENTS

| | | | | | |
|---|---|---|---|---|---|
| 1,475,960 | A | * | 12/1923 | Moody | 248/514 |
| 2,557,859 | A | * | 6/1951 | Bernstein | 116/173 |
| 3,417,732 | A | | 12/1968 | Platt, Jr. | |
| 3,599,599 | A | | 8/1971 | Jones | |
| 3,675,616 | A | | 7/1972 | McInnis | |
| 4,028,827 | A | * | 6/1977 | Hufton | 40/600 |
| 4,332,210 | A | | 6/1982 | Lambert | |
| 4,805,834 | A | * | 2/1989 | Saba | 232/34 |
| 4,864,962 | A | * | 9/1989 | Kuehl et al. | 116/174 |
| 4,920,910 | A | * | 5/1990 | Lin | 116/173 |
| 4,972,794 | A | | 11/1990 | Smyly, Sr. | |
| D340,676 | S | * | 10/1993 | Gallagher | D11/182 |
| D341,551 | S | | 11/1993 | Jones | |
| 5,472,166 | A | * | 12/1995 | Wear | 248/514 |
| 5,520,141 | A | * | 5/1996 | Lutz | 116/173 |
| 5,588,630 | A | * | 12/1996 | Chen-Chao | 248/514 |
| 5,727,583 | A | * | 3/1998 | Kennedy | 135/20.1 |
| 5,829,731 | A | * | 11/1998 | Dean | 248/538 |
| D440,184 | S | | 4/2001 | Jones et al. | |
| 6,978,567 | B1 | * | 12/2005 | Pearsall | 40/666 |

FOREIGN PATENT DOCUMENTS

| | | | |
|---|---|---|---|
| GB | 2420353 | A * | 5/2006 |
| JP | 10222117 | A * | 8/1998 |
| JP | 2004157491 | A * | 6/2004 |

* cited by examiner

*Primary Examiner*—R. Alexander Smith

(57) ABSTRACT

A flag storage and support apparatus includes a housing that has a bottom wall, a top wall, a back wall, a first side wall and a second side wall. A door is hingedly coupled to an edge of the first side wall and is positionable in an open position or a closed position with respect to a front side of the housing. A pole has a bottom end and a top end. The bottom end is pivotally coupled to the bottom wall so that the pole is selectively positionable within the housing to define a stored position or extendable outwardly of the housing to define a display position. A flag is attached to the pole and is positioned adjacent to the top end.

1 Claim, 5 Drawing Sheets

FLAG STORAGE AND SUPPORT APPARATUS

BACKGROUND OF THE INVENTION

1. Field of the Invention

The present invention relates to flag holding devices and more particularly pertains to a new flag holding device for storing a flag on a dwelling wall when not in use and for selectively extending the flag outwardly from the wall in a display position.

2. Description of the Prior Art

The use of flag holding devices is known in the prior art. U.S. Pat. No. 3,599,599 describes a cylindrical housing used for selectively storing a flag when not in use. Another type of flag holding device is U.S. Pat. No. 4,332,210 which includes a system for automatically winding a flag into a housing when not in use. Still another such device is found in U.S. Pat. No. 4,972,794 which includes a flagstaff having a protective housing attached thereto and configured for storing the flag therein when the flag is not in use.

While these devices fulfill their respective, particular objectives and requirements, the need remains for a device that holds a flag to a dwelling wall in such a manner that the flag may be stored in such a way that is generally inconspicuous when the flag is not being used.

SUMMARY OF THE INVENTION

The present invention meets the needs presented above by generally comprising a housing that has a bottom wall, a top wall, a back wall, a first side wall and a second side wall. A door is hingedly coupled to an edge of the first side wall and is positionable in an open position or a closed position with respect to a front side of the housing. A pole has a bottom end and a top end. The bottom end is pivotally coupled to the bottom wall so that the pole is selectively positionable within the housing to define a stored position or extendable outwardly of the housing to define a display position. A flag is attached to the pole and is positioned adjacent to the top end.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
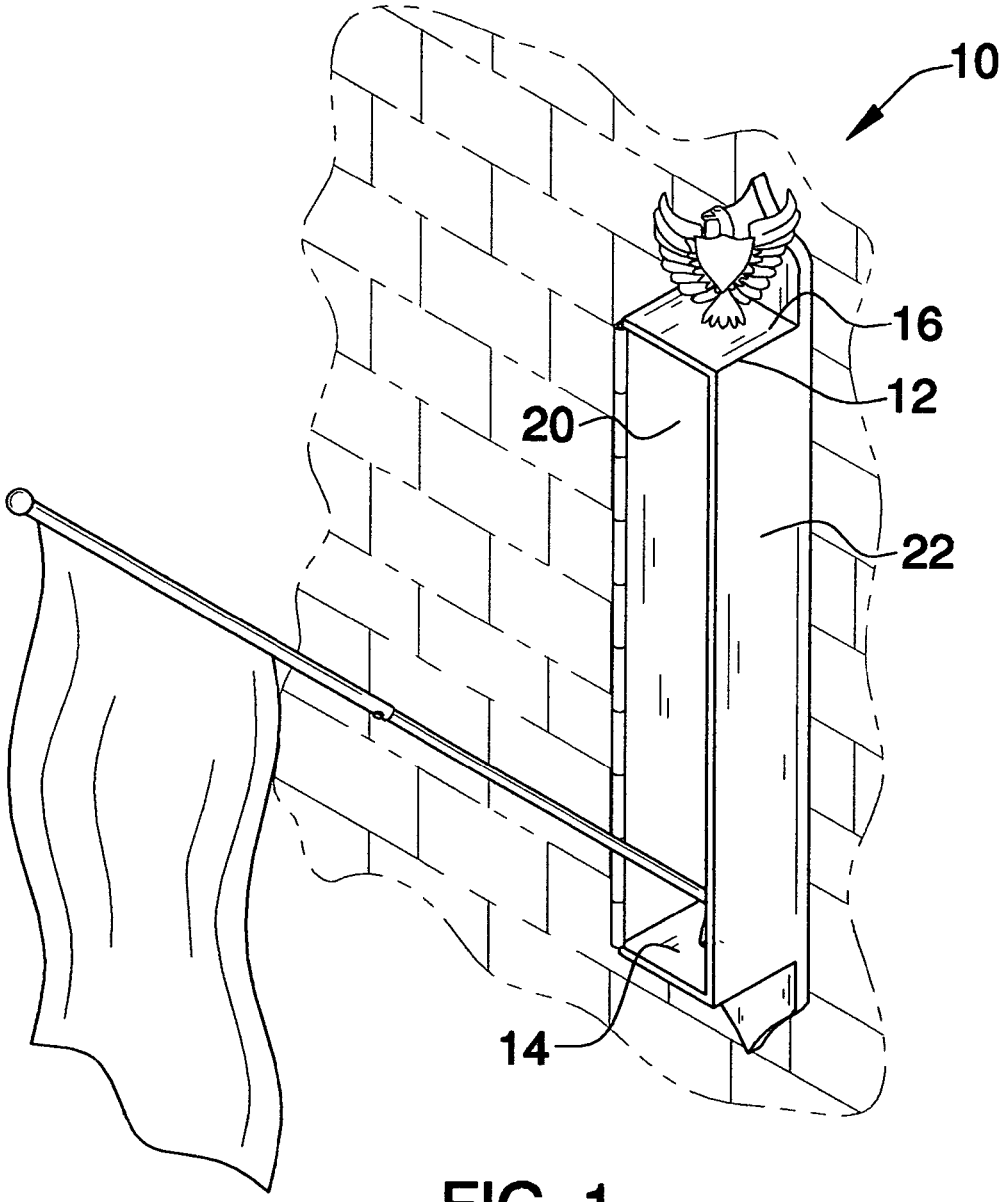
FIG. 1 is a front perspective view of a flag storage and support apparatus according to the present invention.

With reference now to the drawings, and in particular to FIGS. 1 through 6 thereof, a new flag holding device embodying the principles and concepts of the present invention and generally designated by the reference numeral 10 will be described.

As best illustrated in FIGS. 1 through 6, the flag storage and support apparatus 10 generally comprises a housing 12 that has a bottom wall 14, a top wall 16, a back wall 18, a first side wall 20 and a second side wall 22. A door 24 is hingedly coupled to an edge of the first side wall 20 and is positionable in an open position or a closed position with respect to a front side of the housing 12. The housing 12 has a height from the bottom wall 14 to the top wall 16 generally between 30 inches and 50 inches. The housing 12 has a length and width each generally between 4 inches and 8 inches. Address indicia 26 are positioned on an outer surface of the cover.

A pole 28 has a bottom end 30 and a top end 32. The bottom end 30 is pivotally coupled to the bottom wall 14 so that the pole 28 is selectively positionable within the housing 12 to define a stored position or extendable outwardly of the housing 12 to define a display position. The pole 28 is selectively telescoping and includes a first section 34 slidably extendable into a second section 36. A flag 38 is attached to the pole 28 and is positioned adjacent to the top end 32.

A locking bracket 40 is mounted on the bottom wall 14 and is configured to lock the pole 28 at a selected angle with respect to the bottom wall 14. The locking bracket 40 includes at least one plate 42 that is attached to and extends upwardly from the bottom wall 14. A pin 44 is removably extendable through one of a plurality of apertures in the plate 42 and into the pole 28.

A clamp 46 is attached to an inner surface of the back wall 18. The clamp 46 releasably secures the pole 28 in a vertical orientation adjacent to the back wall 18. The clamp 46 may comprise a conventional C-clamp.

Figures 2, 3:
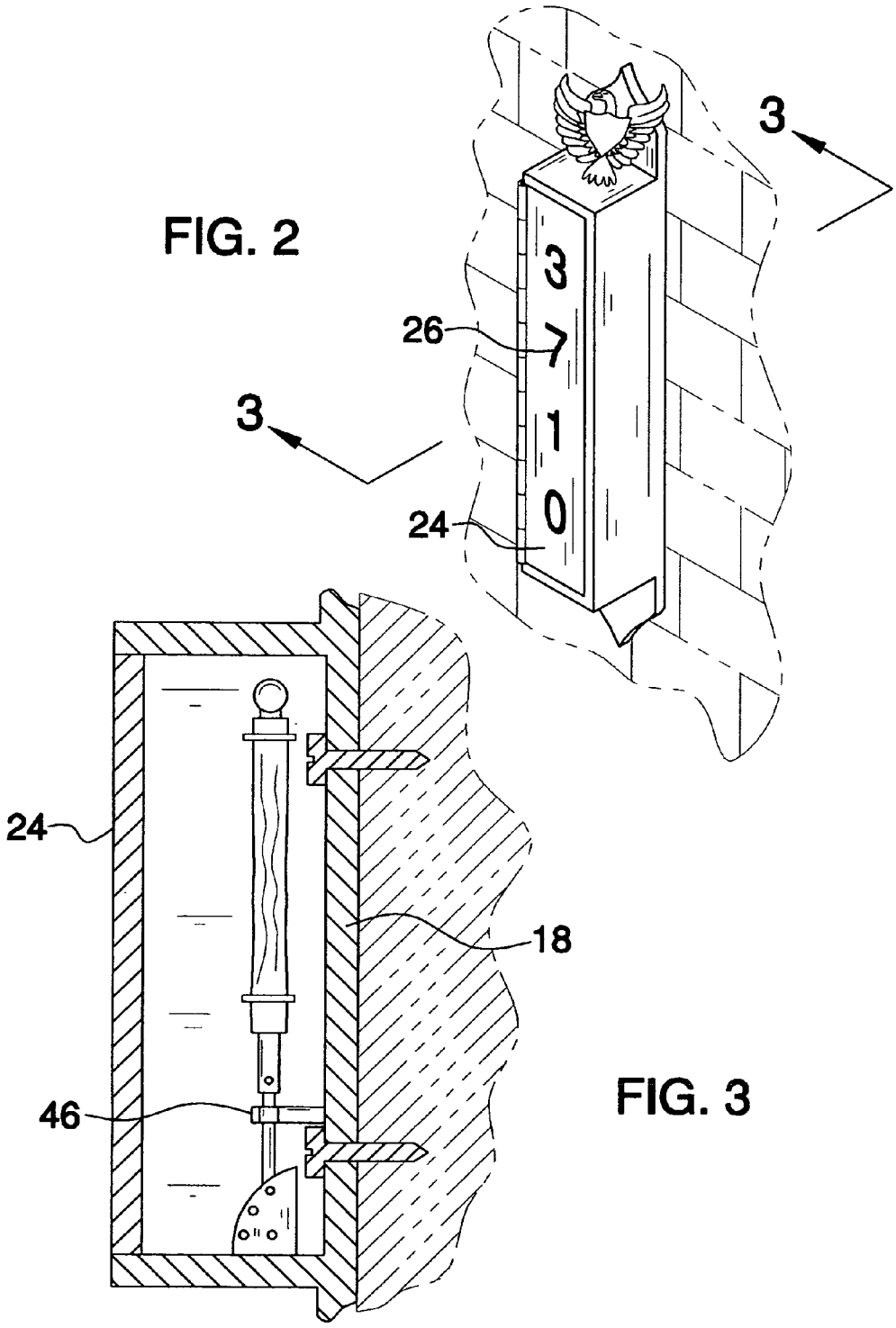
FIG. 2 is a front perspective view of the present invention.
FIG. 3 is a cross-sectional view taken along line 3-3 of FIG. 2 of the present invention.
Figure 4:
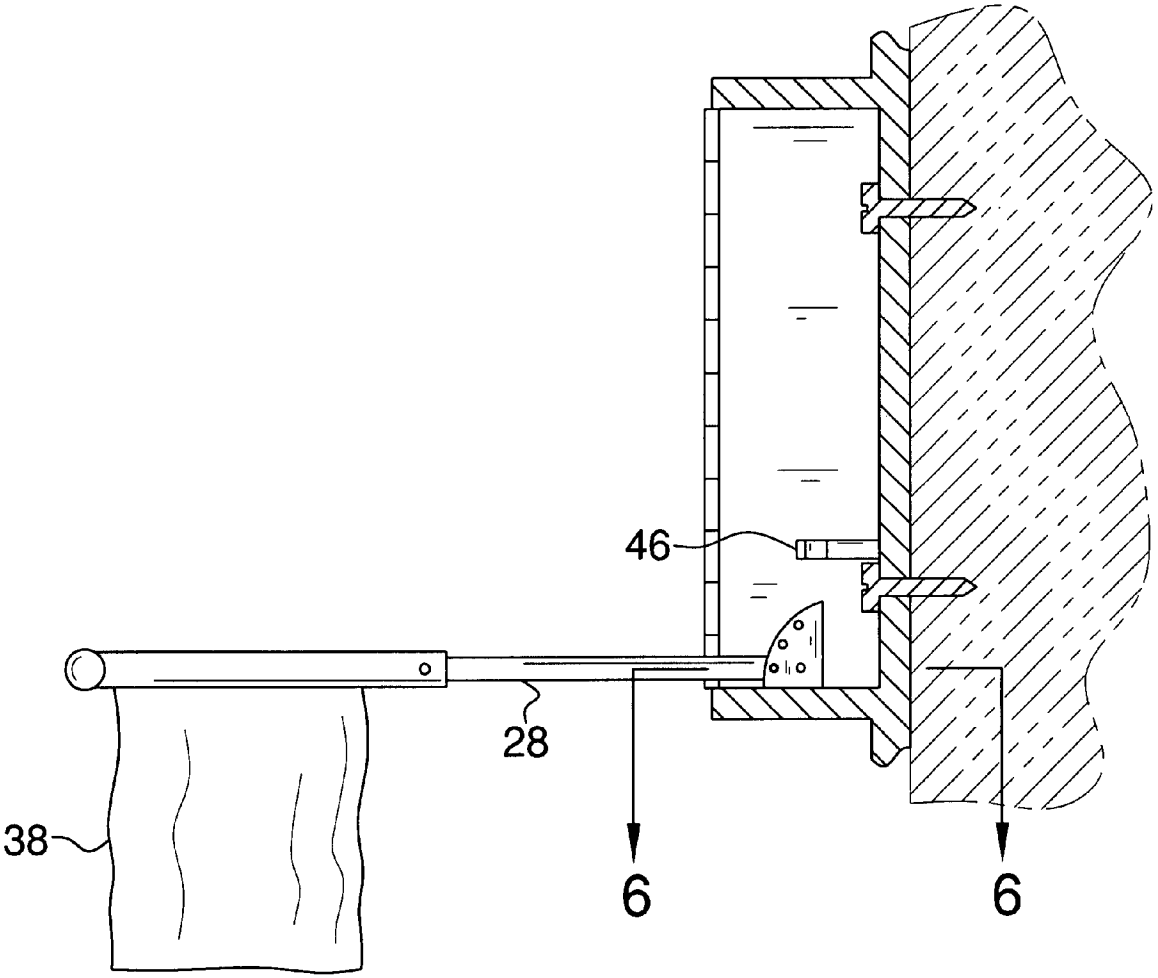
FIG. 4 is a cross-sectional view of the present invention.
Figure 5:
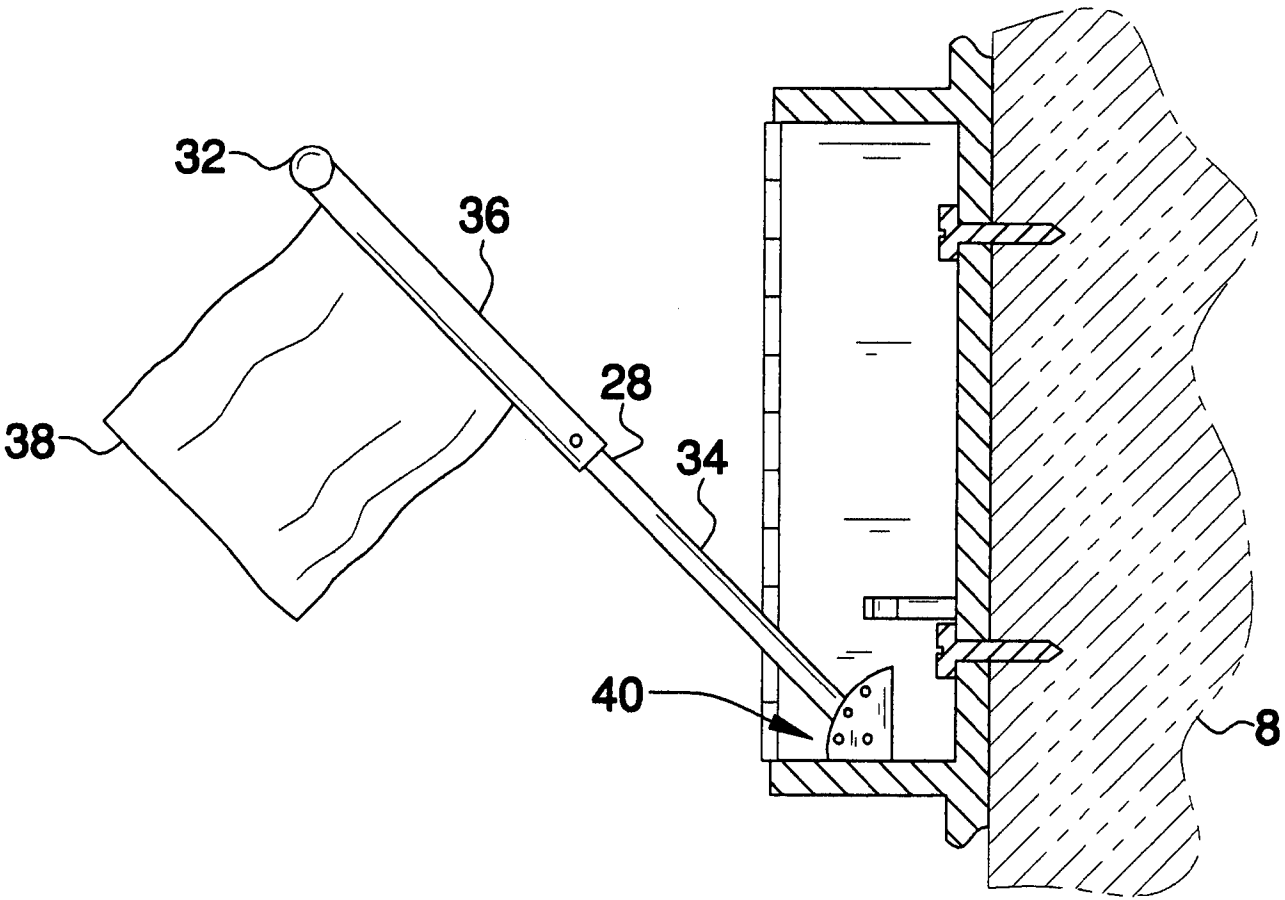
FIG. 5 is a cross-sectional view of the present invention.
Figure 6:
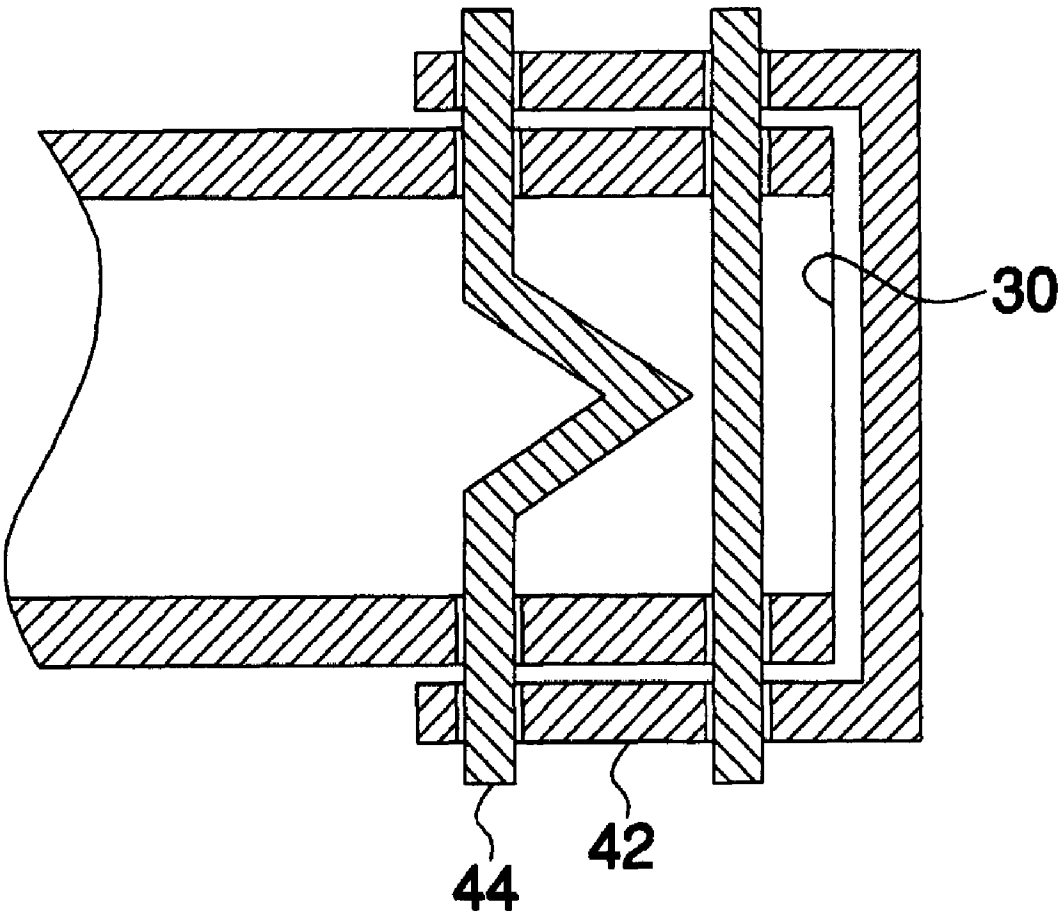
FIG. 6 is a cross-sectional view taken along line 6-6 of FIG. 4 of the present invention.

In use, the housing 12 is mounted on a dwelling wall 8 and is used to store the flag 38 and pole 28 when not in use as shown in FIG. 3. When needed, the door 24 is opened and the flag 38 extended outwardly of the housing 12. The address indicia 24 allow the apparatus 10 to be used as an address indicator while the flag 38 is being stored.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A flag displaying and storage apparatus comprising:

a housing having a bottom wall, a top wall, a back wall, a first side wall and a second side wall, a door being hingedly coupled to an edge of said first side wall and being positionable in an open position or a closed position with respect to a front side of said housing, said housing having a height from said bottom wall to said top wall generally between 30 inches and 50 inches, said housing having a length and width each generally between 4 inches and 8 inches, said back wall being configured for attachment to a dwelling wall;

a pole having a bottom end and a top end, said bottom end being pivotally coupled to said bottom wall such that said pole is selectively positionable within said housing to define a stored position or extendable outwardly of said housing to define a display position, said pole being selectively telescoping, a flag being attached to said pole and being positioned adjacent to said top end;

a locking bracket being mounted on said bottom wall and being configured to lock said pole at a selected angle with respect to said bottom wall, said locking bracket including a pair of plates being attached to and extending upwardly from said bottom wall, said plates each having a plurality of aligned pairs of apertures extending therethrough such that each of said apertures in a first of said plates is aligned with one of said apertures in a second of said plates, said pole being positioned between said plates, a pin being removably extendable through one of said pairs of aligned apertures and through said pole;

a clamp being attached to an inner surface of said back wall, said clamp releasably securing said pole in a vertical orientation adjacent to said back wall; and address indicia abutting and being non-removably attached to an outer surface of said door.

* * * * *